United States Patent [19]

Sasaki et al.

[11] Patent Number: 4,632,078

[45] Date of Patent: Dec. 30, 1986

[54] ARRANGEMENT FOR FACILITATING CORRECT COUPLING BETWEEN DISTRIBUTOR AND DRIVING SHAFT USING ALIGNMENT MARKS

[75] Inventors: Yoshio Sasaki; Masahiko Nishikawa, both of Toyota, Japan

[73] Assignee: Toyota Jidosha Kabushiki Kaisha, Japan

[21] Appl. No.: 777,321

[22] Filed: Sep. 18, 1985

[30] Foreign Application Priority Data

Sep. 26, 1984 [JP] Japan ..... 59-144226[U]

[51] Int. Cl.[4] ..... F02P 7/02

[52] U.S. Cl. ..... 123/146.5 A

[58] Field of Search ..... 123/146.5 A, 146.5 R

[56] References Cited

U.S. PATENT DOCUMENTS 4,186,709 2/1980 Bolles ..... 123/146.5 A

*Primary Examiner*—Andrew M. Dolinar

*Attorney, Agent, or Firm*—Parkhurst & Oliff

[57] ABSTRACT

An arrangement for facilitating correct coupling between a distributor and a cylinder head using a first to fourth alignment marks located either on the distributor or on a cylinder head. The first alignment mark is provided on a coupling claw arranged at the end of a distributor shaft for coupling with a coupling groove at the end of a driving camshaft, the second alignment mark is provided on a housing boss of the distributor, the third alignment mark is provided on a housing body of the distributor; and the fourth alignment mark is provided on the end of the cylinder head accommodating the driving camshaft.

3 Claims, 6 Drawing Figures

ARRANGEMENT FOR FACILITATING CORRECT COUPLING BETWEEN DISTRIBUTOR AND DRIVING SHAFT USING ALIGNMENT MARKS

BACKGROUND OF THE INVENTION

1. Field of the Invention

The present invention relates to an arrangement for facilitating correct coupling between a distributor and a driving shaft. The arrangement according to the present invention is used for coupling a distributor with a driving camshaft of an internal combustion engine 2. Description of the Related Art In general, it is necessary to match the rotational angle of a distributor and the phase of the rotational angle of the driving camshaft to couple a distributor to a driving camshaft or a crankshaft. However, in the prior art, it is difficult for a person assembling the distributor and the cylinder head to achieve this match by visual determination. Therefore, in the prior art, the assembly required special skill and, further, involved much time and trouble.

SUMMARY OF THE INVENTION

It is the object of the present invention to provide a useful and practical arrangement for facilitating correct coupling between a distributor and a cylinder head on the basis of the provision of alignment marks.

According to the present invention there is provided an arrangement for facilitating correct coupling between a distributor and a driving shaft using a plurality of alignment marks located either on the distributor or on a cylinder head. The plurality of alignment marks consist of a first alignment mark provided on a coupling claw arranged at the end of a distributor shaft for coupling with a coupling groove at the end of a driving camshaft, a second alignment mark provided on a housing boss of the distributor, a third alignment mark provided on a housing body of the distributor, and a fourth alignment mark provided on the end of the cylinder head accommodating the driving camshaft. The second and third alignment marks are arranged such that the third and fourth alignment marks align when the first alignment mark on the coupling claw is aligned with the second alignment mark on the housing boss of the distributor and the coupling claw of the distributor is correctly coupled with the coupling groove of the driving camshaft.

DESCRIPTION OF THE PREFERRED EMBODIMENTS

Figure 1:
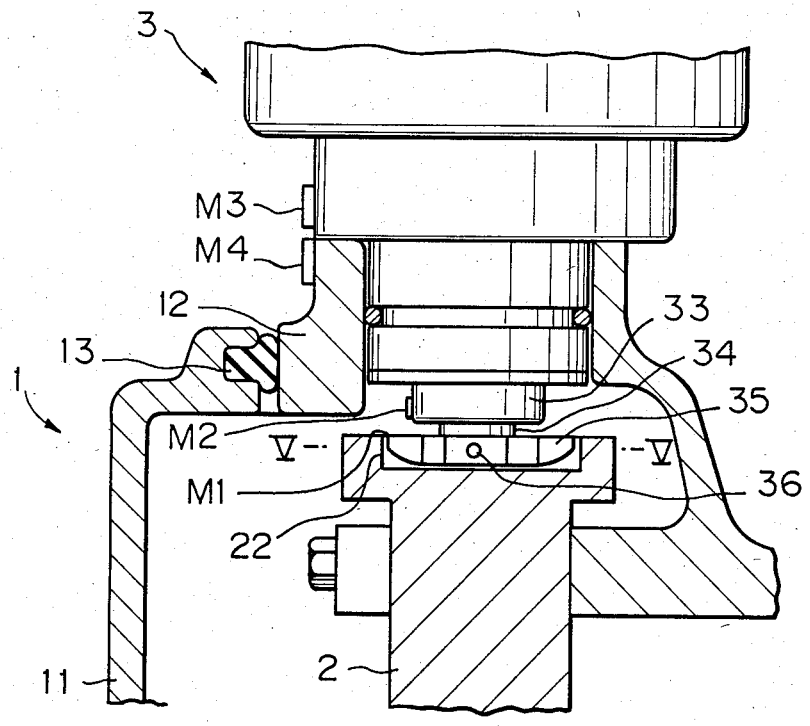
FIG. 1 shows the structure of the coupling between the coupling claw of a distributor and the driving camshaft of a cylinder head according to an embodiment of the present invention.

The structure of the coupling between the coupling claw of a distributor and the driving camshaft of a cylinder head using the alignment marks is shown in FIG. 1. As illustrated in FIG. 1, the distributor 3 is coupled with the driving camshaft 2 by engagement of the coupling claw 35, at the distributor side, with the coupling groove 22, at the driving camshaft side.

The coupling claw 35 is fixed to the end of a distributor shaft 34 by a pin 36. The coupling groove 22 is formed in the driving camshaft at the end portion having an enlarged diameter for engagement with the coupling claw 35.

When the distributor is assembled with the cylinder head, it is required that the rotational angle of the driving camshaft coincide with the rotational angle of the distributor shaft.

In general, the rotation of the crankshaft is transmitted through a belt spanning the crankshaft timing pulley and the camshaft timing pulley, resulting in rotation of the camshaft.

Usually, the position of the coupling groove 22 when the driving camshaft is in the position corresponding to the top dead center of the first cylinder of the engine is adopted as the reference position of the coupling groove 22.

Hence, the coupling claw 35 is fit to the coupling groove 22 in the above-described reference position.

However, the coupling groove 22 at the end of the driving camshaft 2 is situated at a deep position within the cylinder head cover 11. Hence, it is difficult for a person who is assembling the distributor and the cylinder head to discern by eye the position of the coupling groove 22.

Accordingly, a guidance means is needed for attaining correct coupling of the coupling claw 35 with the coupling groove 22. In the structure shown in FIG. 1, a number of alignment marks are used for attaining such correct coupling.

Alignment marks M1, M2, M3, and M4 are provided in the structure shown in FIG. 1. The alignment mark M1 is arranged at one end of the coupling claw 35. It is constituted by a recess formed in the surface of the coupling claw 35.

The alignment mark M2 is arranged at a predetermined position on the cylindrical surface of the housing boss 33 of the distributor 3. The alignment mark M3 is arranged at a predetermined position on the cylindrical surface of the housing body 31 of the distributor 3. The alignment mark M4 is arranged at a predetermined position of the cylindrical surface of the end 12 of the cylinder head 1. Each of the alignment marks M2, M3, and M4 is constituted by a small projection or ridge formed on the surface of the cylindrical body.

The position of the alignment mark M4 is selected for optimum visibility, that is, to enable the person assembling the distributor and the cylinder head to readily discern the mark M4.

The alignment mark M2 is arranged so as to be aligned with the alignment mark M1 when the alignment mark M3 is aligned with the alignment mark M4 and the coupling claw 35 is correctly engaged with the coupling groove 22.

In FIG. 1, the alignment mark M2 and the alignment mark M3 are shown positioned in the same plane including the axis of the distributor 3. In other words, the alignment mark M2 and the alignment mark M3 are aligned on the external surface of the distributor 3. In the manufacturing process for a distributor, the alignment marks should be constructed so that the above-described positional relationship stands.

Figure 2:
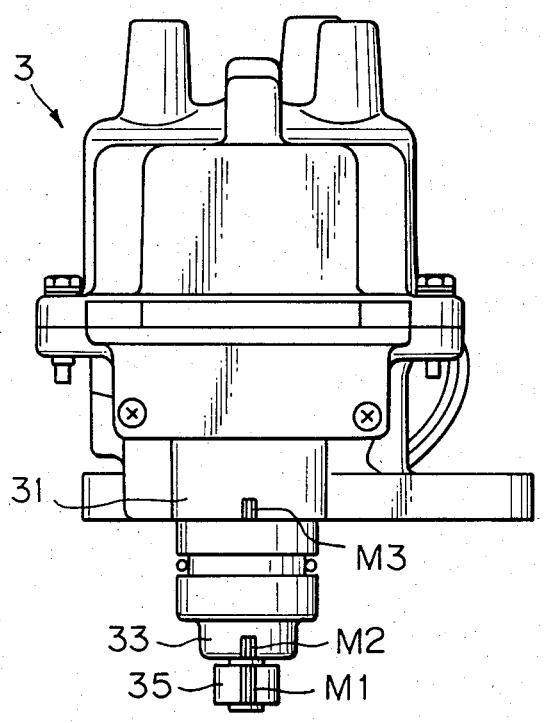
FIG. 2 shows the positional relationship between the distributor and the cylinder head immediately before coupling.
Figure 2:
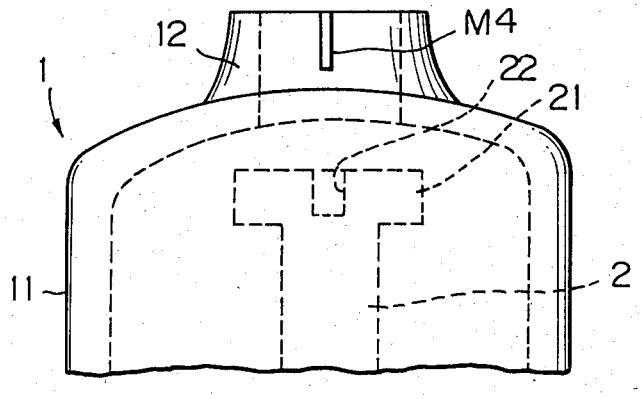

The positional relationship between the distributor 3 and the cylinder head 1 immediately before coupling is illustrated in FIG. 2. In FIG. 2, the alignment marks M3, M2, and M1 are all aligned, that is, positioned in one plane. The distributor 3 is positioned with respect to the cylinder head 1 so that the alignment mark M4 at the cylinder head side is aligned with the alignment marks M3, M2, and M1.

While maintaining the above-described positional relationship, the distributor 3 is brought close to the cylinder head 1 to cause the coupling claw 35 to be engaged with the coupling groove 22 and thus to attain the coupled state shown in FIG. 1.

Figure 3A:
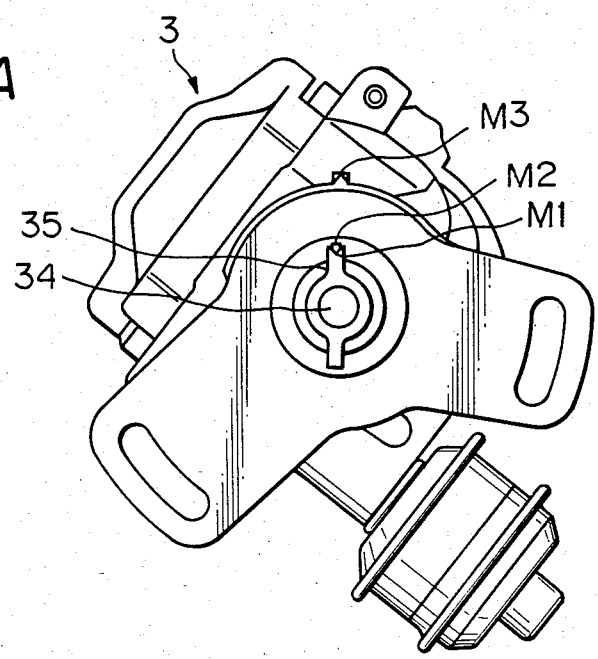
FIG. 3A is a bottom view of the distributor shown in FIG. 2.
Figure 3B:
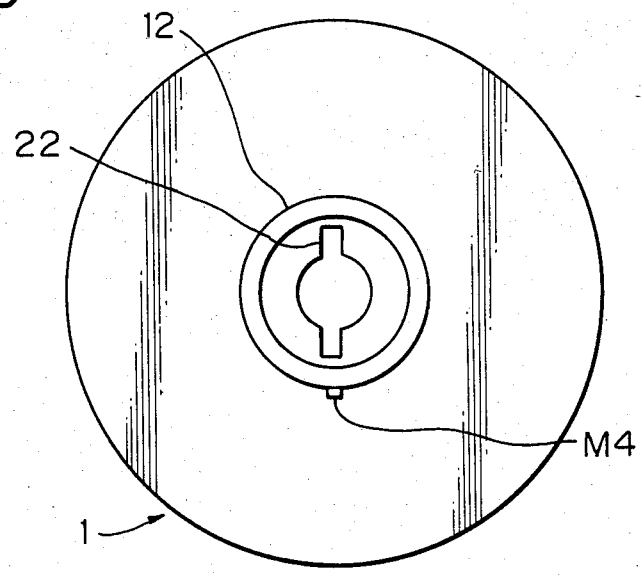
FIG. 3B is a top view of the cylinder head shown in FIG. 2.

A bottom view of the distributor 3 shown in FIG. 2 is given in FIG. 3A. A top view of the cylinder head 1 shown in FIG. 4 is given in FIG. 3B.

Figure 4:
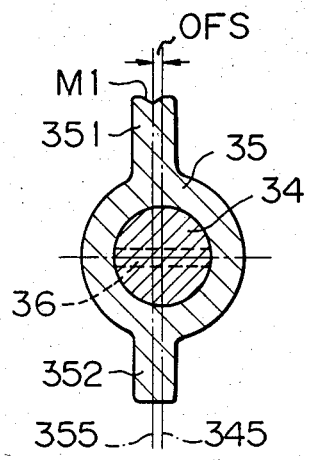
FIG. 4 is a cross-sectional view of the coupling claw of the distributor.

The structure of the coupling claw 35 used in the structure shown in FIG. 1 is shown in FIG. 4. The structure of the coupling claw is designed from the viewpoint that erroneous engagement between the coupling claw and coupling groove at a 180° advanced angular position from the regular angular position should be avoided.

For this purpose, the center plane 353 of the coupling claw 35 is offset a little from the center plane 345 by an offset OFS. By this design of the coupling claw 35, erroneous engagement between the coupling claw and coupling groove is avoided.

Figure 5:
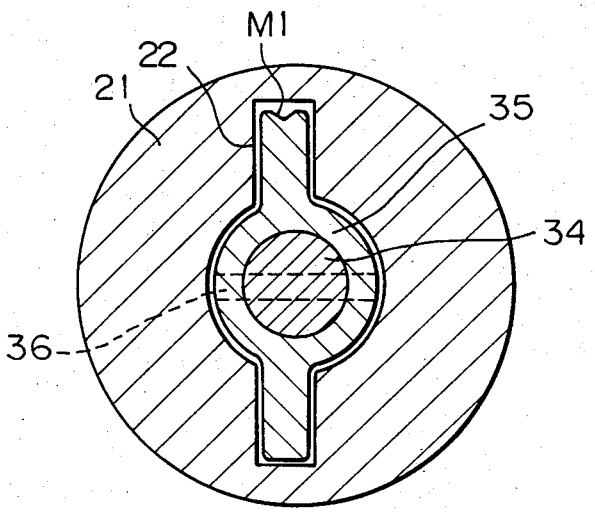
FIG. 5 is a cross-sectional view of the structure of the coupling between the coupling claw and the coupling groove along the line V—V in FIG. 1.

As mentioned previously, the alignment mark M1 is formed as a recess at one end 351 of the coupling claw 35, the coupling claw 35 is engaged with the coupling groove 22 of the end 21 of the driving camshaft as illustrated in FIG. 5, which is a cross-sectional view along the line V—V in FIG. 1.

The transition from the state illustrated in FIG. 2, i.e., the state immediately before coupling, to the state illustrated in FIG. 1, i.e., the state upon completion of the coupling, will be understood from the illustrations of FIGS. 1 and 2. That is, even if the alignment marks M1 and M2 are not visible, i.e., if only the alignment mark M3 and the alignment mark M4 can be seen, correct coupling between the coupling claw of the distributor side and the coupling groove of the cylinder head side can be achieved by the alignment mark M3 and the alignment mark M4 provided the alignment mark M3 is aligned with the alignment marks M1 and M2.

In FIG. 1 and FIG. 2, the alignment mark M4 is arranged at the top position of the end 12 of the cylinder head 1, corresponding to the direction of the coupling groove 22. However, instead of the above, the direction of the coupling groove 22 may be turned by a preselected angle with respect to the alignment mark M4. In this case, the position of the alignment marks M2 and M3 should be turned by the above-mentioned preselected angle. On the basis of such a preselected angle, correct coupling between the coupling claw 35 and the coupling groove 22 can be carried out.

We claim:

1. An arrangement for facilitating correct coupling between a distributor and a driving shaft using a plurality of alignment marks located either on the distributor or on a cylinder head, said plurality of alignment marks consisting of:

a first alignment mark provided on a coupling claw arranged at the end of a distributor shaft for coupling with a coupling groove at the end of a driving camshaft;

a second alignment mark provided on a housing boss of the distributor;

a third alignment mark provided on a housing body of the distributor; and a fourth alignment mark provided on the end of the cylinder head accommodating the driving camshaft;

said second and third alignment marks arranged in a manner that said third and fourth alignment marks align when said first alignment mark on the coupling claw is aligned with said second alignment mark on the housing boss of the distributor and the coupling claw of the distributor is correctly coupled with the coupling groove of the driving camshaft.

2. An arrangement according to claim 1, wherein said first alignment mark is constituted by a recess formed in the surface of said coupling claw.

3. An arrangement according to claim 1, wherein said second, third, and fourth alignment marks are constituted by small projections formed on the surface of cylindrical bodies.

* * * * *